US008944135B2

(12) United States Patent
Spray

(10) Patent No.: US 8,944,135 B2
(45) Date of Patent: Feb. 3, 2015

(54) ADJUSTABLE LIFT CORD ANCHOR FOR MOVABLE RAILS IN COVERINGS FOR ARCHITECTURAL OPENINGS

(75) Inventor: Jeffrey L. Spray, Erie, CO (US)

(73) Assignee: Hunter Douglas Inc., Pearl River, NY (US)

( * ) Notice: Subject to any disclaimer, the term of this patent is extended or adjusted under 35 U.S.C. 154(b) by 25 days.

(21) Appl. No.: 13/489,643

(22) Filed: Jun. 6, 2012

(65) Prior Publication Data

US 2012/0312486 A1 Dec. 13, 2012

Related U.S. Application Data

(60) Provisional application No. 61/494,000, filed on Jun. 7, 2011.

(51) Int. Cl.
*E06B 9/388* (2006.01)

(52) U.S. Cl.
USPC ..... 160/168.1 R; 160/173 R; 160/178.1 R; 242/396.1; 242/611.1; 242/388.2

(58) Field of Classification Search
USPC ..... 160/173 R, 168.1 R, 178.1 R; 242/395, 242/396.1, 611.1, 388.2, 388.4; 24/115 L, 24/127
See application file for complete search history.

(56) References Cited

U.S. PATENT DOCUMENTS

| | | | | |
|---|---|---|---|---|
| 3,327,765 | A * | 6/1967 | Strahm et al. | 160/168.1 R |
| 5,974,763 | A | 11/1999 | Colson et al. | |
| 6,119,757 | A | 9/2000 | Judkins et al. | |
| 6,792,997 | B2 * | 9/2004 | Damiano | 160/178.1 R |
| 7,363,955 | B2 | 4/2008 | Hindhede et al. | |
| D636,204 | S | 4/2011 | Elinson et al. | |
| 8,006,735 | B2 | 8/2011 | Collum et al. | |
| 2004/0026048 | A1 * | 2/2004 | Damiano | 160/178.1 R |
| 2009/0294076 | A1 | 12/2009 | McNiel | |
| 2012/0312486 | A1 * | 12/2012 | Spray | 160/340 |

FOREIGN PATENT DOCUMENTS

| | | | |
|---|---|---|---|
| DE | 7228454 | U | 10/1972 |
| DE | 102009008773 | A1 | 8/2010 |
| DE | 102009008774 | A1 | 8/2010 |
| EP | 0192867 | A1 | 9/1986 |

* cited by examiner

*Primary Examiner* — Blair M. Johnson
(74) *Attorney, Agent, or Firm* — Dorsey & Whitney LLP

(57) ABSTRACT

An adjustable anchor for anchoring a lift cord in a movable rail of a covering for an architectural opening includes a housing which is releasably positionable interiorly of the movable rail in alignment with a lift cord for the covering with the anchor including a rotatable drum within the housing and around which the lift cord can be wrapped or unwrapped by rotating movement of the drum with a tool. Two distinct systems are provided for releasably securing the drum in any selected position to retain the amount of lift cord wrapped therearound with the two system acting in mutually perpendicular planes for reliable anchoring of the lift cord.

26 Claims, 7 Drawing Sheets

ADJUSTABLE LIFT CORD ANCHOR FOR MOVABLE RAILS IN COVERINGS FOR ARCHITECTURAL OPENINGS

CROSS REFERENCE TO RELATED APPLICATIONS

The present application claims the benefit under 35 U.S.C. §119(e) to U.S. provisional patent application No. 61/494,000 filed 7 Jun. 2011, entitled "Adjustable Lift Cord Anchor for Movable Rails in Coverings for Architectural Openings," which is hereby incorporated by reference into the present application in its entirety.

FIELD

The present disclosure relates generally to retractable coverings for architectural openings and more particularly to a system for adjustably anchoring a lift cord that extends between rails used in the covering. The effective length of the lift cord extending between the rails in the covering is adjustable to adjust the maximum distance between the rails as permitted when the covering is fully extended.

DESCRIPTION OF THE RELEVANT ART

Retractable coverings for architectural openings such as windows, doors, archways and the like have been utilized for many years. While the coverings may retract horizontally as in a vertical blind, most retractable coverings retract vertically, such as roller blinds, Venetian Blinds, cellular shades, and the like.

Coverings that retract vertically typically include a headrail and one or more movable rails operatively connected to the headrail by lift cords so that an operating mechanism for the covering can adjust the effective length of the lift cords as they extend from the headrail to one or more movable rails so that the movable rails can be desirably positioned within the architectural opening. A flexible shade material typically extends between the headrail and a first movable rail or between movable rails in coverings referred to as top-down/bottom-up coverings, but again the lift cords are manipulated from the headrail so as to move the one or more movable rails toward or away from the headrail to retract or extend the covering.

The lift cords have typically been connected to associated movable rails by establishing a knot in the lift cord and retaining the knot within or below the rail but as will be appreciated, it is very difficult to position a knot at a precisely desired location so that the rail is not only desirably and dependably spaced from the headrail for the covering when the covering is fully extended but is also desirably positioned horizontally so as to be parallel with the headrail. Typically there at least two lift cords, but there can be more depending upon the width of the covering. Desirably establishing the effective lengths of the lift cords determines a maximum spacing between rails and also the spacial orientation of the rail so that it can be positioned horizontally.

It is to provide an improved and simplified system for adjusting the effective length of lift cords for coverings for architectural openings that the present disclosure has been developed.

SUMMARY

The lift cord anchor of the present disclosure is designed for use in conventional bottom up vertically movable retractable coverings for architectural openings, but can also be used in top-down/bottom-up coverings. The anchor may be a two-piece anchor having an outer housing in which is disposed a rotatable drum to which the lower end of a lift cord in a retractable covering can be operably connected. The housing is slidably positionable within a hollow movable rail of a covering for an architectural opening so as to be positionable in alignment with an associated lift cord that extends from a headrail for the covering through a flexible and retractable shade material to the movable rail. In top-down/bottom-up coverings, the shade material extends between movable rails of the covering and the anchor of the present disclosure can be used with either of the movable rails while being positionable within the movable rail to be aligned with an associated lift cord for connection therewith.

To connect a lift cord to the anchor, the lift cord is extended through a hole or aperture defined in the top surface of the movable rail and then pulled through an open end of the rail where it can be operably connected to the rotatable drum prior to the rotatable drum being snap-fit (or otherwise connected) into the housing of the anchor. Once the lift cord is operably connected to the anchor, the housing is slidably inserted into the open end of the movable rail until it is aligned with the hole through the top of the movable rail receiving the lift cord and the anchor is thereafter frictionally retained in that position.

To adjust the effective length of the lift cord with the anchor, the drum is provided with a tool or screw slot that is accessible through a hole provided through the movable rail in alignment with the screw slot so that a screwdriver or other tool can be used to rotate the drum, thereby wrapping the lift cord about the drum to shorten the effective length of the lift cord. The effective length can be lengthened by rotating the drum in the opposite direction once a plurality of wraps have been provided around the drum. The drum is retained in selected positions relative to the housing with two separate retaining systems so that once the drum is set relative to the housing for a pre-selected length of the lift cord, it will substantially retain this position until the position is adjusted by overcoming the retaining systems with a screwdriver or other similar tool.

Anchors may be provided along the length of the movable rail at substantially any location where a lift cord is desired to be connected to the movable rail. In some instances the covering may include at least two lift cords so that the movable rail can be suspended in a horizontal and parallel relationship with the headrail for the covering. In these instances, adjusting the length of the lift cords with the adjustable anchor of the present disclosure, the maximum allowed spacing between the headrail and the movable rail in a bottom-up covering or between movable rails in a top-down/bottom-up covering can be set or the inclination of the movable rail relative to horizontal can be adjusted so that the rail in its fully extended location is horizontal and parallel with the headrail.

Other aspects, features and details of the present disclosure can be more completely understood by reference to the following detailed description of a preferred embodiment, taken in conjunction with the drawings and from the appended claims.

DETAILED DESCRIPTION

Figure 1:
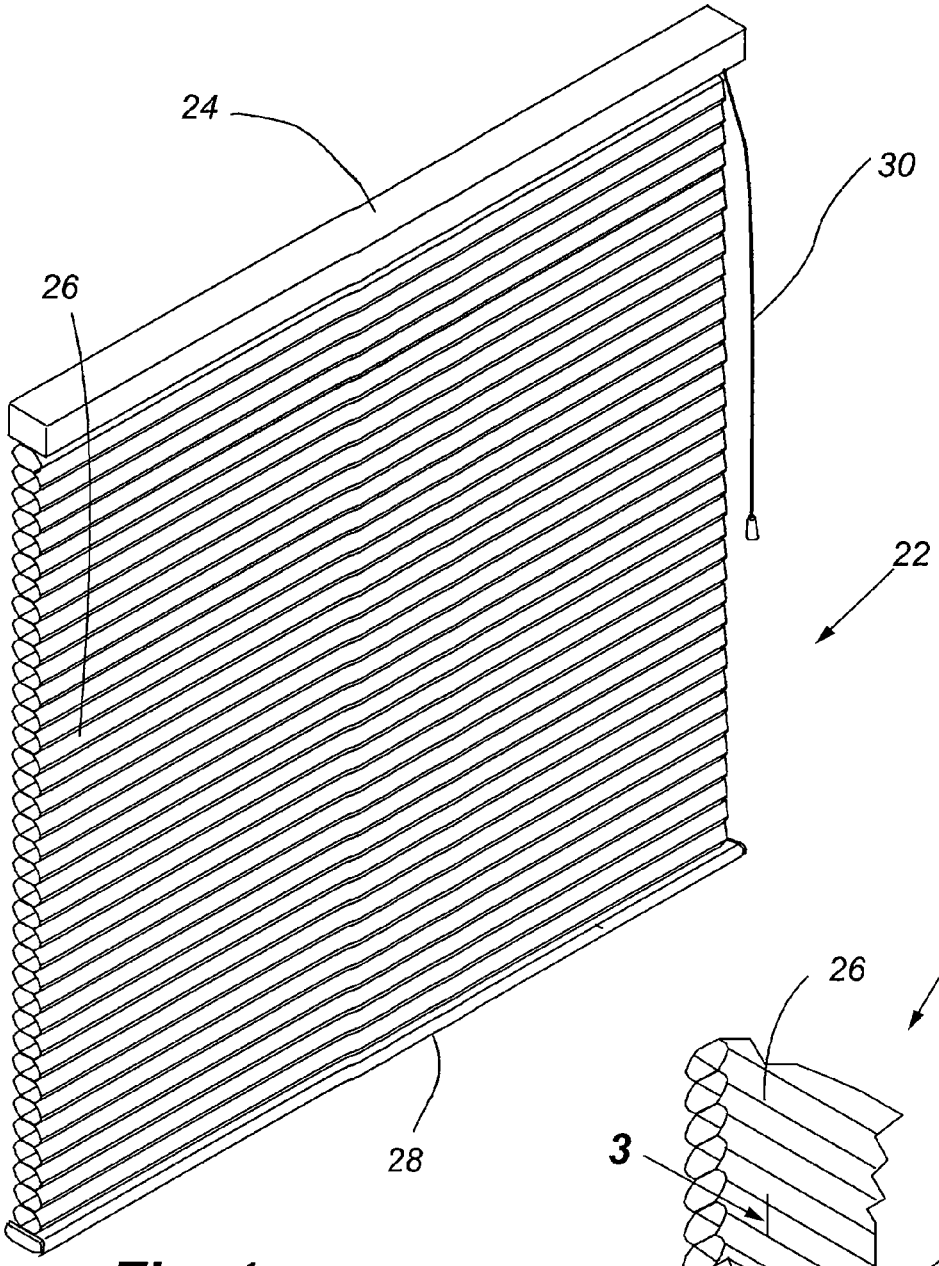
FIG. 1 is an isometric of a retractable covering incorporating the lift cord anchor of the present disclosure in a fully extended condition.

The adjustable lift cord anchor or connector 20 of the present disclosure may be used in retractable coverings 22 for architectural openings, such as of the type shown in FIG. 1. It will there be seen that such as covering, which is shown for illustrative purposes only since the anchor could be used in numerous forms of retractable coverings, includes a headrail 24 from which is suspended a retractable cellular shade material 26 having a movable bottom rail or ballast 28. A control system for operating the covering includes a manually operable pull cord 30 that is suspended from one end of the headrail. In some instances, the pull cord 30 may extend downwards to a height that may generally be reachable by an operator who can pull down on the cord to retract the covering from the extended position shown in FIG. 1 to a retracted position (not shown). In the retracted position, the bottom rail may generally be positioned closely adjacent to the headrail with the shade material collapsed and stacked therebetween. A releasable lock (not shown) is provided in the headrail to hold the pull cord and thus the covering in substantially any desired position and can be released to allow the covering to drop to its fully extended position. The control system further includes lift cords 32 (see FIGS. 4, 7, 8 and 9) which are operatively connected to the pull cord and extend downwardly from the headrail to the bottom rail at least two locations where they are at least temporarily anchored so that shortening the effective length of the lift cords (from the headrail to the bottom rail) causes the bottom rail to be raised toward the headrail while lengthening the effective length of the lift cords allows the bottom rail to drop by gravity away from the headrail.

Figure 2:
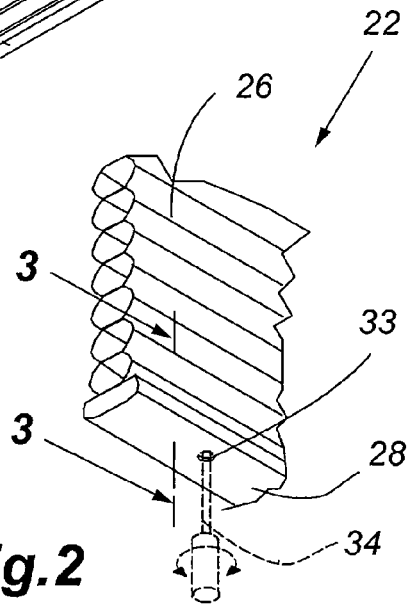
FIG. 2 is an enlarged fragmentary isometric looking upwardly at the lower left end of the bottom of the shade showing an access opening for adjusting the anchor of the present disclosure with a tightening device such as a screwdriver shown in dashed lines.
Figure 3:
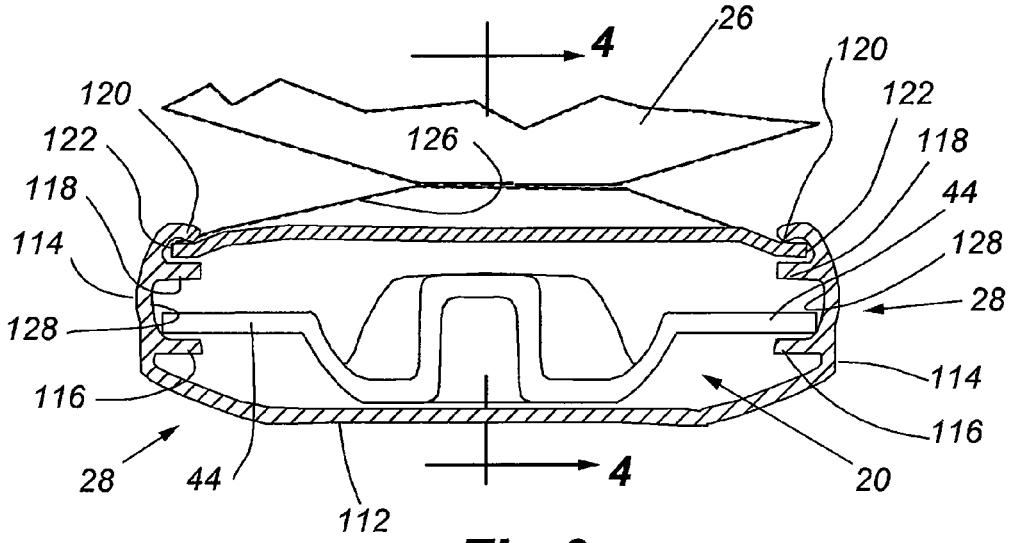
FIG. 3 is a further enlarged fragmentary section taken along line 3-3 of FIG. 2.
Figure 4:
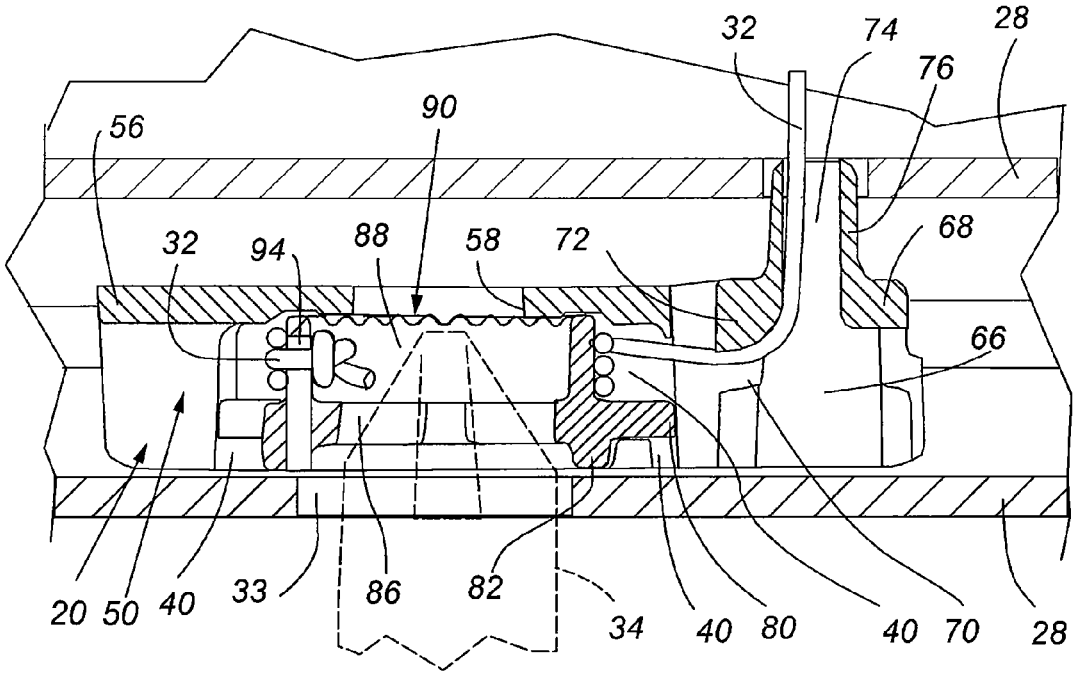
FIG. 4 is a fragmentary section taken along line 4-4 of FIG. 3.
Figure 5:
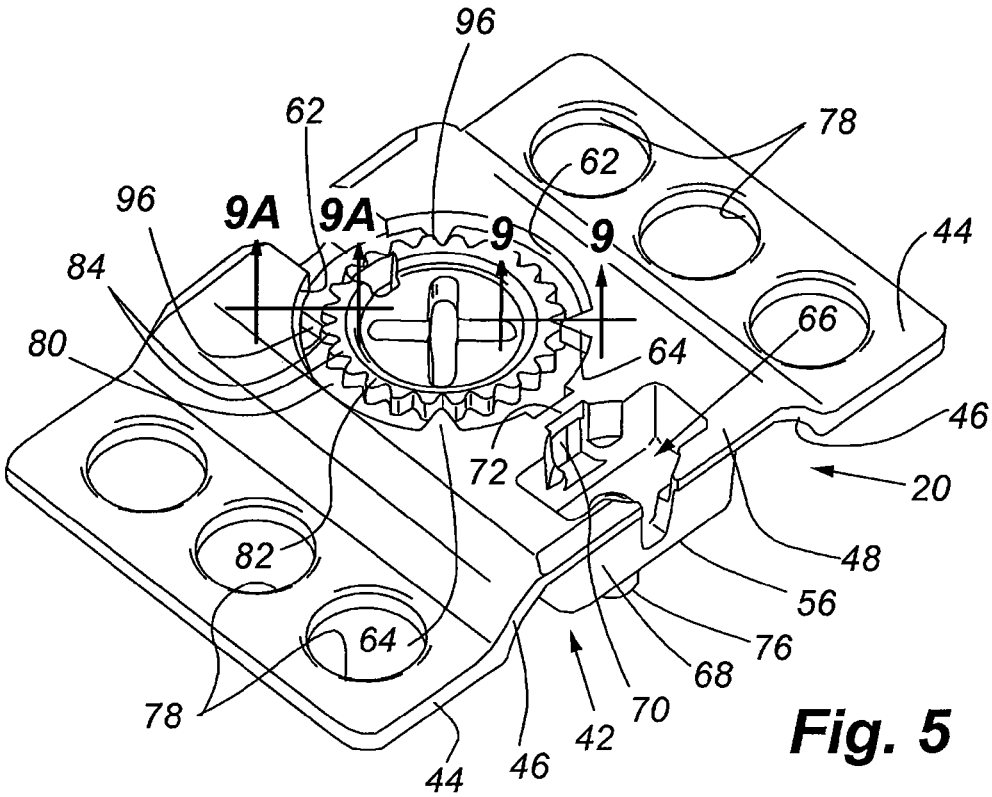
FIG. 5 is an isometric looking upwardly on the anchor of the present disclosure.
Figure 6:
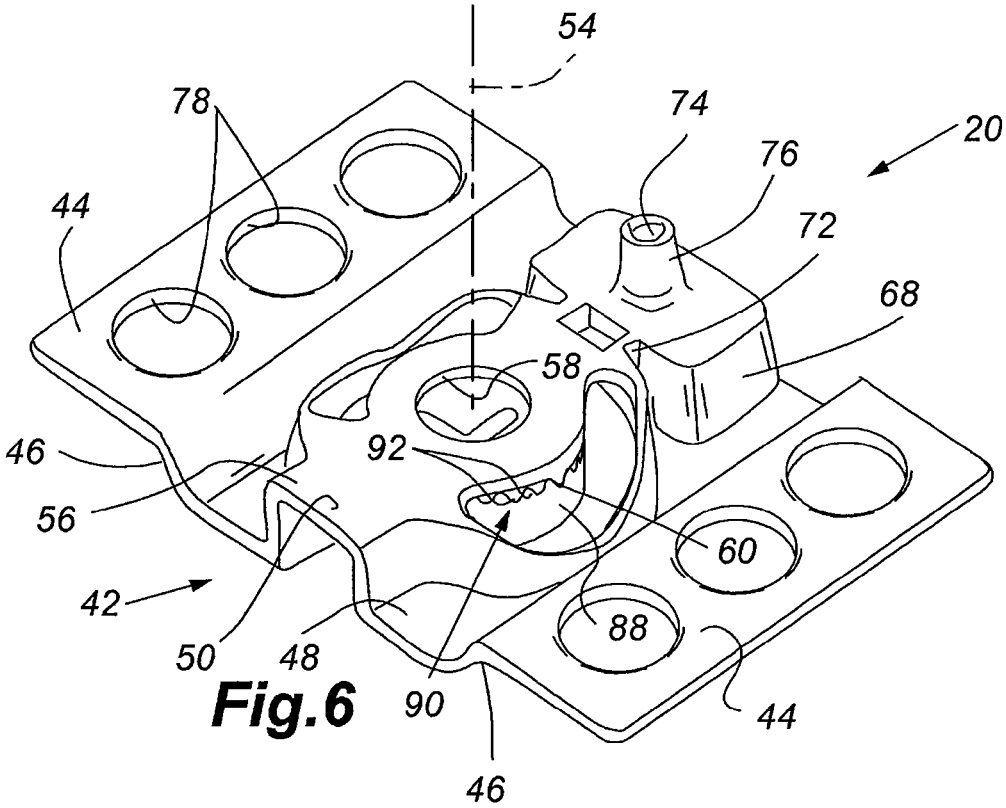
FIG. 6 is an isometric similar to FIG. 5 looking downwardly at the anchor of the disclosure.

While not shown in FIG. 1, but shown in FIGS. 3 and 4, the adjustable anchor 20 of the present disclosure is positioned within the bottom rail 28 at a location associated with a given lift cord 32 or other operating element and is adjusted as shown for example in FIG. 2 with a fastening tool, such as a screwdriver, or other suitable tool 34, inserted through a hole 33 defined in the bottom rail so that the effective length of the lift cord associated with the anchor can be regulated.

Figure 7:
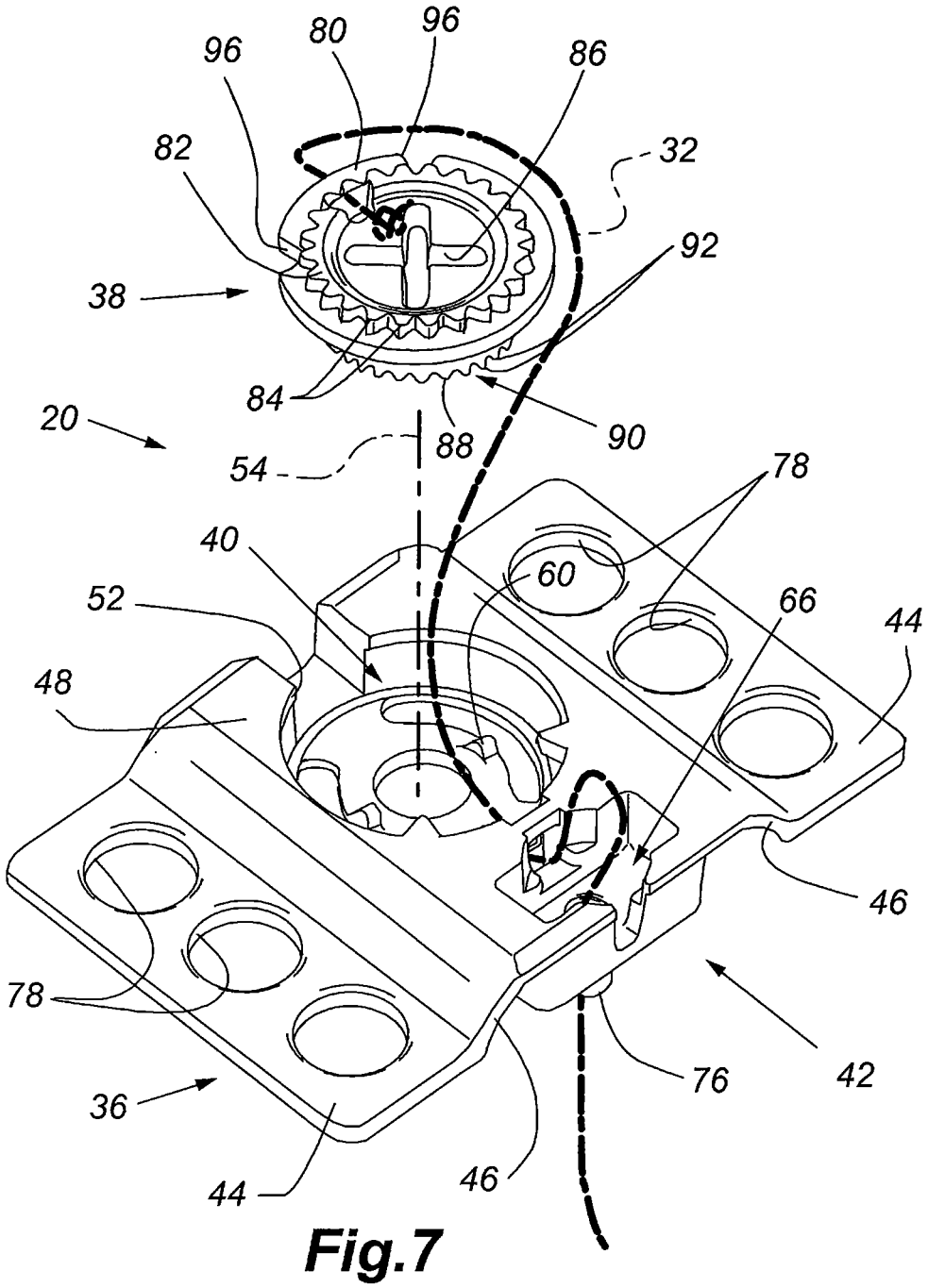
FIG. 7 is an exploded isometric similar to FIG. 5 with a lift cord connected to the anchor being shown in dashed lines.
Figure 8:
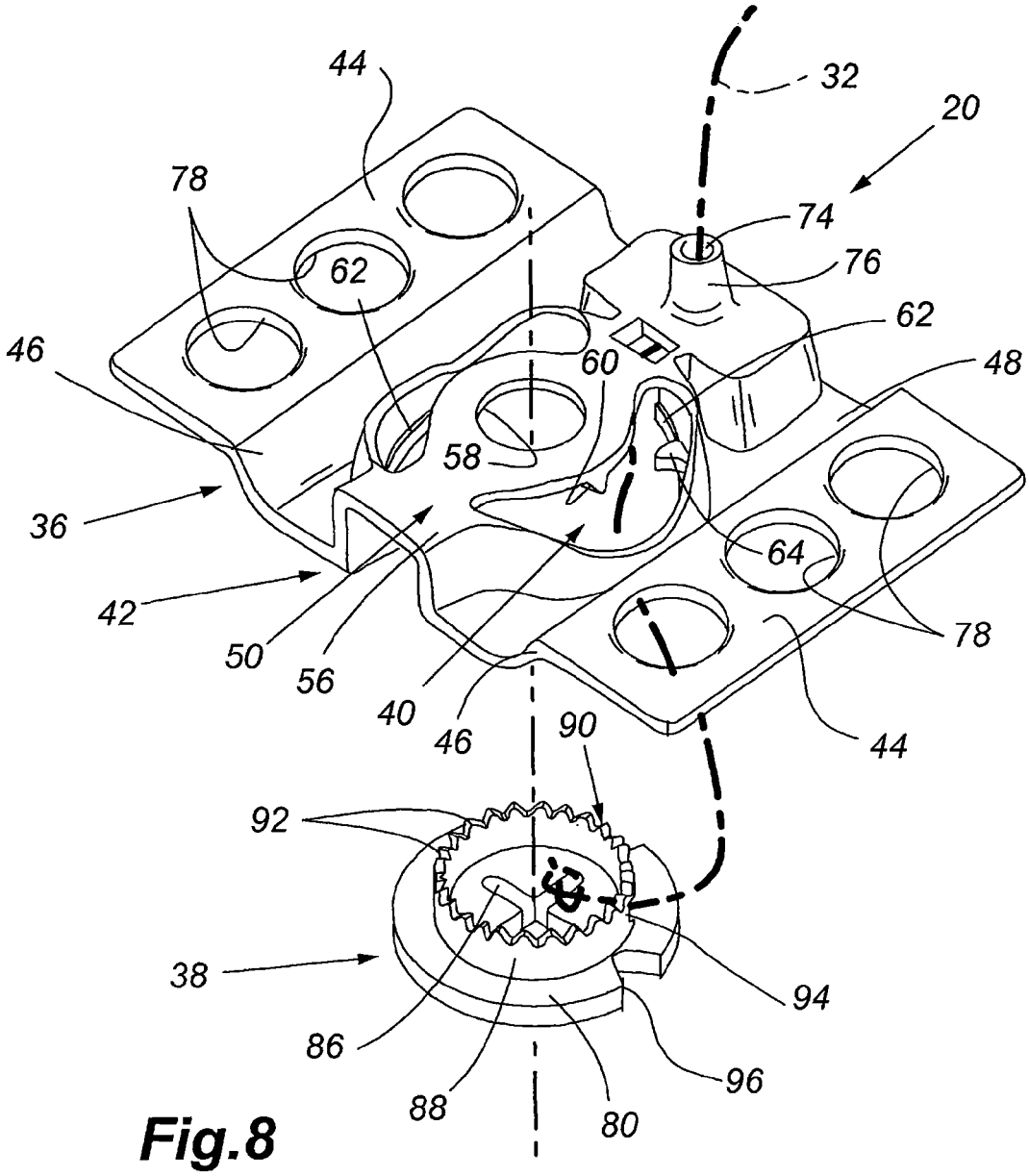
FIG. 8 is an exploded isometric similar to FIG. 6 with a lift cord being connected to the anchor being shown in dashed lines.
Figure 9:
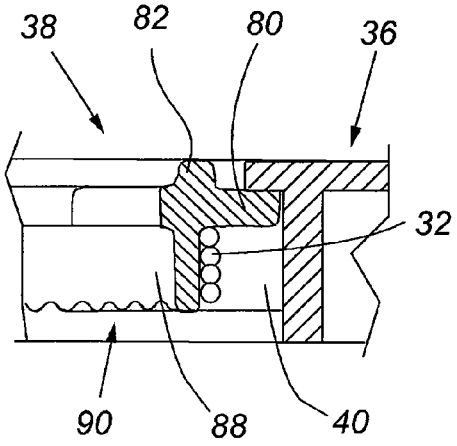
FIG. 9 is an enlarged section taken along line 9-9 of FIG. 5.
Figure 10:
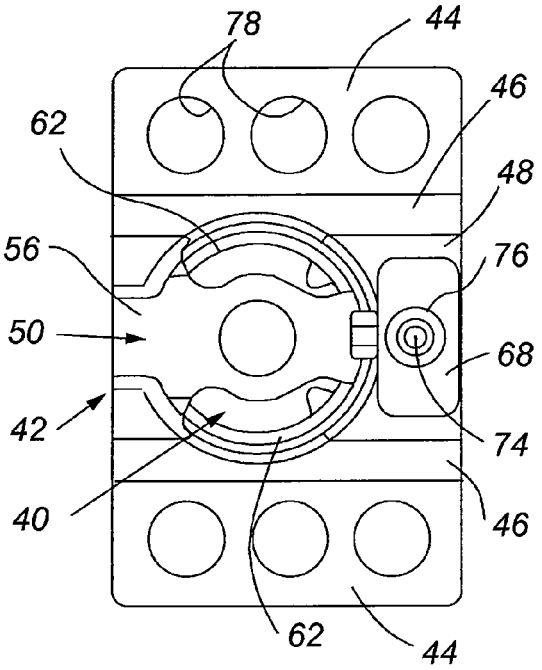
FIG. 10 is a top plan view of the anchor of the present disclosure.
Figure 9A:
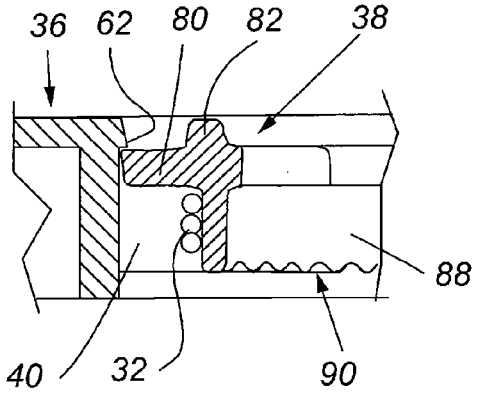
FIG. 9A is an enlarged section taken along line 9A-9A of FIG. 5.
Figure 11:
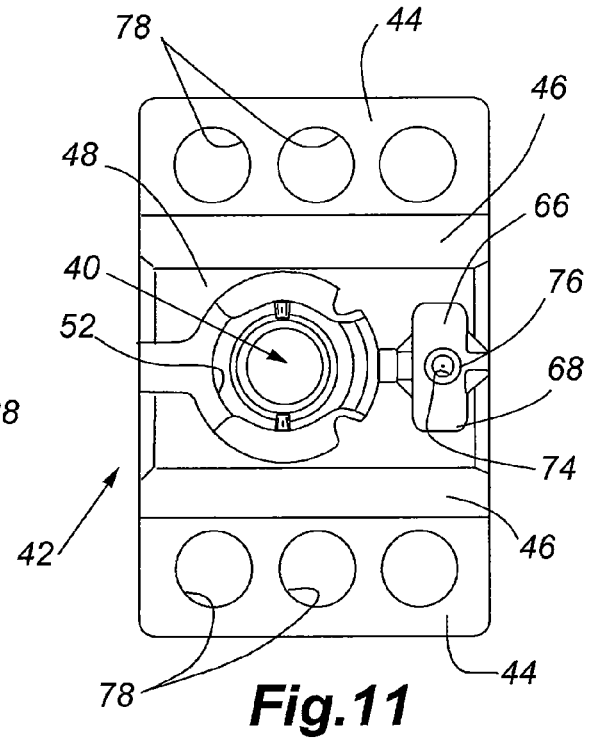
FIG. 11 is a bottom plan view of the anchor of the present disclosure.

With reference to FIGS. 7 and 8, the adjustable anchor 20 may be a two-piece anchor including a housing 36 and a rotatable drum 38 with the drum being rotatably seated within a cylindrical recess or receiving cavity 40 of the housing. The drum is adapted to be operably connected to the end of a lift cord 32 in a manner such that the lift cord can be wrapped about or unwrapped from the drum by rotating the drum in a selected direction.

Looking first at the housing 36 as possibly seen best in FIGS. 5, 6, 7, 8, 10 and 11, it can be seen to include a main body portion 42 and a pair of oppositely directed ears 44 or flanges of generally rectangular configuration which are horizontally disposed but operably connected to the main body by connector plates 46 or connector members which slope upwardly and outwardly away from a base plate 48 of the main body portion. The base plate has formed thereon a substantially cylindrical raised body 50 defining the cylindrical receiving cavity 40 which opens downwardly through a substantially drum opening 52 for receipt of the rotatable drum 38 with the cavity having an axial axis 54. The top wall 56 of the raised body has a centrally located passage 58, which may be substantially circularly shaped, therethrough and a pair of diametrically opposed downwardly directed catches 60 (FIG. 7) for a purpose to be described hereafter. Also diametrically opposed along a bottom edge of the cavity 40 so as to be co-planar with the drum opening 52 in the main body, are a pair of arcuate flanges 62 which overlie a small portion of the receiving cavity also for a purpose to be described hereafter. Generally co-planar with the arcuate flanges, are a pair of radially directed teeth or catches 64 which extend inwardly into the cavity 40 along the edge of the substantially drum opening 52 whose function will also be described hereafter.

A second downwardly opening cord receiving cavity 66, which may have a generally rectangular cross-sectional configuration, is formed in a second raised body 68 which extends upwardly from the base plate 48 with the cord receiving cavity being in communication with the substantially receiving cavity 40 through a passage 70 in a bridge 72 between the cavities. The top of the cord receiving cavity 66 has an opening 74 (FIG. 5) therethrough which communicates with an upwardly projecting spout 76 through which a lift cord 32 can slidably pass as will be described hereafter. The opening 74 may be dimensioned to receive the lift cord 32 and in some instances may have a generally circular shape and a dimension larger than a diameter of the lift cord 32. The spout 76 may be parallel to the axial axis 54 of the cylindrical cavity but spaced laterally therefrom.

It should be noted the main body 42 for the anchor 20 may generally be made of a substantially rigid material having some resiliency whereby when it is mounted within the movable rail 28 of the covering it can be wedged into a frictionally fixed position within the rail. Further, as will be appreciated with the description that follows, the resiliency of the material allows the rotatable drum 38 to be snap fit into the receiving recess 40 so as to be rotatably retained therein. The ears 44 may further include one or more apertures 78 defined therethrough. The holes 78 may reduce the material required to produce the anchor 20, and thus may reduce the weight of the anchor 20 as well. Accordingly, in some instances, the holes 78 may be omitted.

It should be noted that the receiving cavity 40 may be dimensioned and shaped to receive the drum 38, such that the drum 38 may rotate therein. Accordingly, depending on the desired shape and dimensions of the drum 38, which may be varied depending on the covering, size, and/or length of the lift cords, the receiving cavity 40 and/or housing may correspondingly be varied.

With reference to FIGS. 7 and 8, the rotatable drum 38 may include a substantially circular intermediate disc 80 with a pinion gear 82 integrally formed concentrically on a bottom surface thereof with the gear being of a slightly smaller diameter than the disc. The gear defines a plurality of radially extending teeth 84 or engagement members which are spaced inwardly from the outer circumference of the disc. At a centered location in the disc, an x-shaped tool passage 86 is provided though the disc of a shape to receive a Phillips head or conventional screwdriver with the passage being accessible from either side of the disc. The tool passage 86 could be of other configurations to accommodate different tools such as an Allen wrench or the like. Projecting upwardly and concentrically from the disc and which may be formed integrally therewith is a cylindrical body 88 having a serrated upper edge 90 defining a plurality of teeth 92 or other engagement members that may be disposed in a circular array along the upper edge of the cylindrical body so as to extend in parallel relationship with the axis of the rotatable drum. The rotatable drum of course rotates about this axis when it is positioned within the cylindrical recess 40 of the housing. In this manner, the teeth 84 of the pinion gear 82 may extend in a first plane relatively perpendicular to the teeth 92 of the cylindrical body which may extend in a second plane.

The outer wall of the cylindrical body 88 defines a wrapping surface about which a lift cord 32 can be wrapped and a notch 94 is formed through the sidewall at one or more locations so that a lift cord can be inserted through the notch and knotted or otherwise operably connected within the interior of the cylindrical body (as shown in FIG. 7) to connect the lift cord to the rotatable drum. The intermediate disc 80 has a pair of radial notches 96 formed in its outer circumference which conform in size and shape to the teeth or catches 64 formed on the housing 36 which overlie the receiving recess 40 in which the drum is positioned.

To mount the rotatable drum 38 in the housing 36, it is aligned with the receiving recess 40 so that the cylindrical body 88 of the drum extends upwardly toward the top wall 56 of the raised body 50 of the housing and the pair of notches 96 in the intermediate disc of the rotatable drum are aligned with the teeth or catches 64 of the housing which are along the bottom of the receiving recess 40. Once so positioned, the rotatable drum can be compressed upwardly so the outer edge of the intermediate disc 80 engages and flexes upwardly the arcuate flanges 62 on the housing so that they permit the drum to slide thereby and allow it to be fully inserted into the recess. Once so positioned, the arcuate flanges snap back due to the resiliency of the material from which the housing is made to hold the rotatable drum in the cavity.

The two teeth or catches 64 along the bottom edge of the receiving recess 40 are sized so they slightly intermesh with the radial teeth 84 on the bottom of the rotatable drum 36 whereby when the drum is rotated, the teeth or catches 64 snap into and out of the gaps between the teeth 84 on the bottom of the rotatable drum to sequentially and releasably retain the drum in a selected angular position relative to the housing. Similarly, the teeth 92 on the top edge of the cylindrical wall of the rotatable drum engage the catches 60 extending downwardly from the top wall 56 of the raised body 50 so that as the drum is rotated the catches also snap in and out of the gaps between the teeth 92 on the top of the drum.

It will therefore be appreciated that two systems are provided for releasably holding the drum 38 in a selected position relative to the housing 36 with one system working in a vertical plane and the other system in a horizontal plane or, in other words, the two systems may operate in mutually perpendicular planes to assist in releasably retaining the drum in substantially any selected position. The selected position of the drum may be obtained by rotating the drum with a rotation tool 34 which can be inserted downwardly through the passage 58 through the top wall of the raised body 50 or upwardly through the hole 33 in the bottom rail and into the open bottom of the cavity 40.

The lift cord 32 or operating element associated with an anchor 20 in the covering 22 of the type illustrated in FIG. 1 passes into the bottom rail 28 through an opening (not shown) formed in the top of the bottom rail so that it can be inserted downwardly through the spout 76 of the anchor housing 36 and subsequently through the cord receiving cavity 66 and the passage 70 through the bridge 72 into the receiving recess 40 where it is operably connected to the rotatable drum 38. Rotation of the drum thereby causes the cord to be wrapped about the drum or unwrapped from the drum which is performed depending upon whether or not the effective length of the lift cord is desired to be lengthened or shortened.

In the covering 22 illustrated in FIG. 1, the access hole 33 for the tool 34 for adjusting the rotatable drum 38 is through the bottom of the bottom rail 28 as shown in FIG. 2 inasmuch as the shade material 26 covers the top of the bottom rail. As the drum is rotated, it is snapped between releasably locked positions which are established with the catches 60 on the top wall 56 of the raised body 50 and the array of the teeth 92 on the top edge of the cylindrical body 88 and the teeth or catches 64 along the bottom edge of the cylindrical recess 40 and their cooperation with the circular array of radial teeth 84 on the bottom pinion gear 82 of the rotatable drum. The teeth or catches 64 along the bottom edge of the cylindrical recess are positioned adjacent to and on opposite sides of the passage 70 though the bridge 72 where the lift cord 32 enters the cylindrical recess 40 so that as tension is placed on the cord the rotatable drum 38 is biased toward the two teeth or catches 64 which assure a more positive interaction of the teeth or catches 64 with the pinion gear teeth 84 on the rotatable drum.

Figure 12:
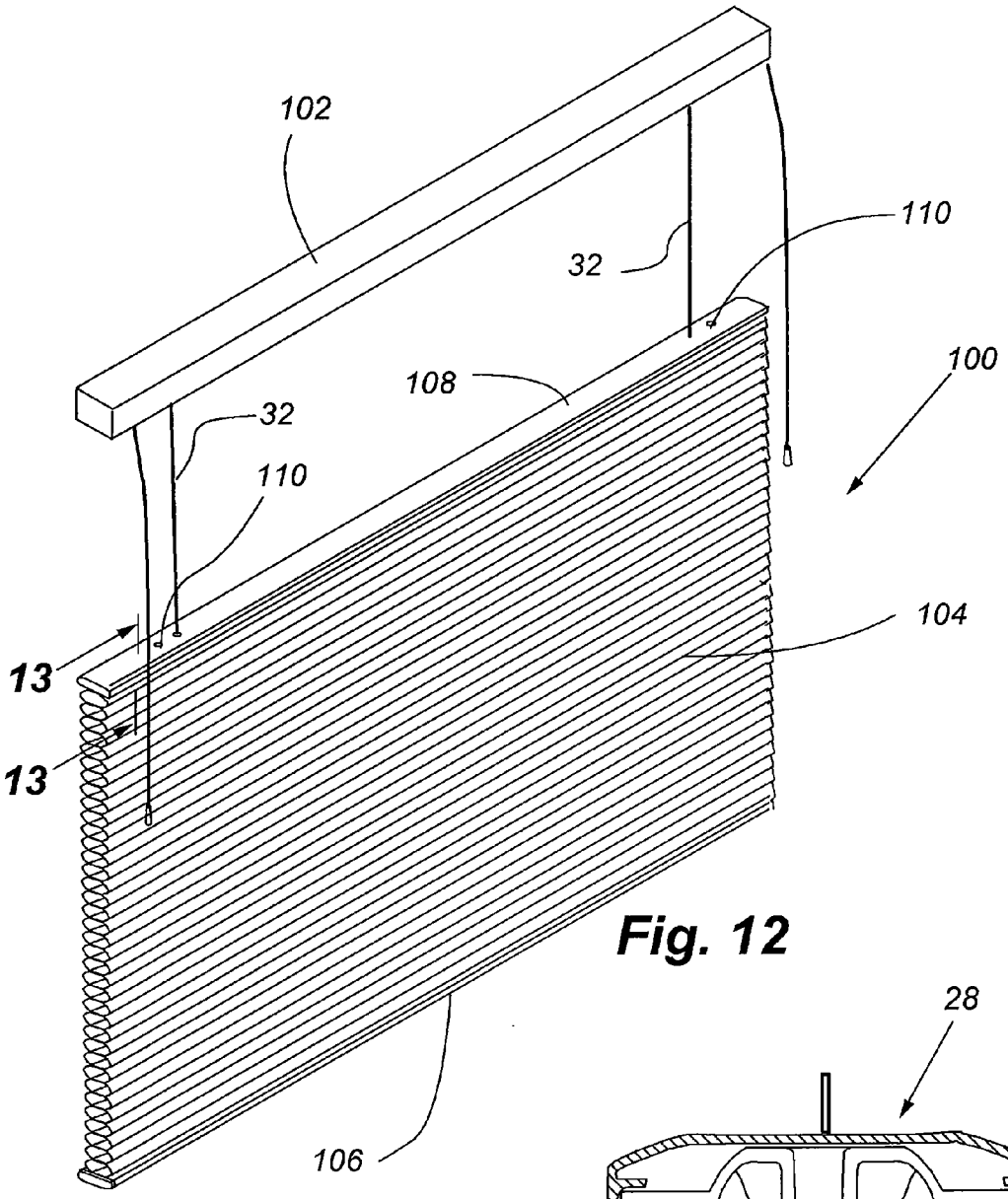
FIG. 12 is an isometric of a top-down/bottom-up covering incorporating the anchor of the present disclosure with the covering shown in a partially extended condition.
Figure 13:
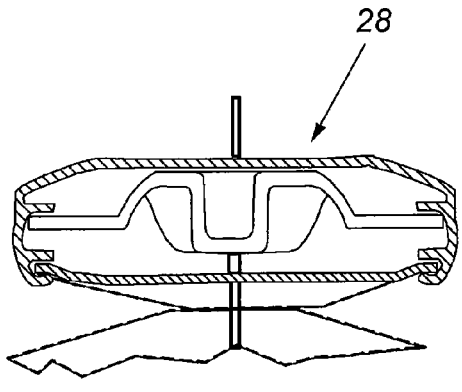
FIG. 13 is an enlarged fragmentary section taken along line 13-13 of FIG. 12.

With reference to FIGS. 12 and 13, a top-down/bottom-up covering 100 is shown where the covering has a headrail 102 through which lift cords 32 extend but the retractable shade material 104 is disposed between a lower bottom rail 106 and a middle rail 108. As mentioned previously, the anchor 20 of the present disclosure can be used in both the bottom rail and the middle rail and when used in the bottom rail it is as previously described. When used in the middle rail, it may be inserted into the rail in an inverted orientation so the spout 76 faces the shade material. The lift cords are adjusted on a middle rail anchor through holes 110 in the top of the middle rail where there is no fabric to obstruct use of a tool such as a screwdriver. In other words, due to the fact that a tool can access the rotatable drum from either the top or bottom of the anchor, it is used to access the drum through the surface of the rail not having shade material connected thereto.

With reference to FIG. 3, it can be appreciated that a rail such as the bottom rail 28 which might be used with the anchor of the present disclosure may have a bottom wall 112, a pair of side walls 114, a lower set of support flanges 116 extending inwardly from the side walls and an upper set of flanges 118 extending inwardly from the side walls along with longitudinally extending overhangs 120 along the top of the rail. The overhangs define longitudinally extending slots 122 along the side edges of the rail so that an anchor plate or strip 124 can be inserted into the bottom cell 126 of a cellular shade material 26 of the type shown and then flexibly inserted between the overhangs so as to be retained therein to secure the rail to the associated end of the shade material. The anchor 20 is then slidably inserted into the rail 28 between the upper 118 and lower 120 pairs of flanges which define a groove 128 therebetween for receipt of the ears 44 of the housing and desirably, the housing is slightly oversized so that the ears frictionally engage the inner surfaces of the side walls 114 of the rail so as to remain in a desired selected position relative to the length of the rail where a lift cord 32 enters the rail.

Although the present disclosure has been described with a certain degree of particularity, it is understood the disclosure has been made by way of example, and changes in detail or structure may be made without departing from the spirit of the disclosure as defined in the appended claims.

What is claimed is:

1. A covering for an architectural opening comprising:
a headrail;
a shade material suspended from the headrail;
a rail operably connected to an edge of the shade material;
a control system operatively associated with the headrail, the control system including a plurality of flexible lift elements operably connected to and supporting the rail, the lift elements being manipulated by the control system to adjust the effective length of the lift elements whereby the spacing of the rail from the headrail can be adjusted; and
a connector operably connected to the rail and adjustably connected to one of the lift elements, the connector including
a housing selectively positionable and operably connected to the rail;
a rotatable drum rotatably seated within a portion of the housing; and
a first catch system and a second catch system, wherein the two catch systems hold the drum in a position relative to the housing; wherein
a position of the connector along a length of the connected lift element is variable and the spacial orientation and position of the rail is determined by location of the connector to the connected lift element;
the housing includes a receiving recess and the drum is rotatably seated in the receiving recess; and
the drum further includes an array of teeth extending axially from an axial end of the drum and the housing further includes at least one protrusion in alignment with the array of teeth to releasably engage the array of teeth to releasably prevent rotation of the drum relative to the housing.

2. The covering of claim 1 wherein the catch systems operate in mutually perpendicular planes.

3. The covering of claim 1, wherein the housing has a receiving recess to rotatably receive the drum, a cord recess in the housing, and a communicating passage between the receiving recess and the cord recess, wherein the one of the lift cords extends into the cord recess and through the passage into the receiving recess where the one of the lift cords can be selectively wrapped about a cylindrical body of the drum to vary the effective length of the one lift cord.

4. The covering of claim 3, wherein the rail is substantially hollow and the connector is positioned interiorly within the rail, and the housing further including a spout communicating with the second recess and the exterior of the rail through which the element can pass.

5. The covering of claim 4, wherein the receiving recess has a central axial axis parallel with the spout and being displaced laterally from the spout.

6. An anchor for selectively securing a lift cord for a covering for an architectural opening, comprising:
a housing configured to be operably connected to a rail operably connected to the covering, the housing including a receiving recess defined in a main body; and
a drum rotatably received within the receiving recess and configured to be operably connected to the lift cord, the drum including
a first set of engagement members extending in a first plane and engageable with the housing; and
a second set of engagement members extending in a second plane and engageable with the housing; wherein
rotation of the drum selectively rotates the lift cord around a portion of the drum;
the first plane is substantially perpendicular to the second plane; and
the housing is a rigid material having sufficient resiliency to snap-fit into the rail, wherein the housing further defines a cord receiving recess and a cord passage extending between the cord receiving recess and the receiving recess.

7. The anchor of claim 6, wherein the drum further includes a sidewall extending from a bottom surface, wherein the lift cord is configured to wrap around at least a portion of the sidewall and the first set of engagement members are defined on an upper edge of the sidewall.

8. The anchor of claim 6, wherein the housing further includes
a first set of catches extending downwardly into the receiving recess from an upper surface of the housing; and
a second set of catches extending horizontally into the receiving cavity from a bottom surface of the housing; wherein
the first set of catches interact with the first set of engagement members and the second set of catches interact with the second set of engagement members.

9. The anchor of claim 6, wherein the drum further defines a tool aperture configured to receive a tool for selectively rotating the drum within the receiving recess.

10. The anchor of claim 9, wherein the housing further defines a hole in an upper surface, wherein the hole defined in the housing is substantially aligned with the tool aperture in the drum.

11. The anchor of claim 6, wherein the housing further includes a pair of ears operably connected to either side of the main body.

12. The anchor of claim 11, wherein the housing further includes a pair of connection members that extend upwardly and outwardly from the main body and are connected to the pair of ears.

13. A covering for an architectural opening comprising:
a head rail;
a shade operably connected to the head rail;
a rail operably connected to the shade;
an operating element operably connected to the shade and configured to transition the shade between an extended position and a retracted position; and
an anchor operably connected to the rail and the operating element, the anchor including
a housing operably connected to the rail, the housing including a receiving recess defined in a main body; and
a drum rotatably received within the receiving recess and operably connected to the operating element, the drum including
a first set of engagement members extending in a first plane; and a second set of engagement members extending in a second plane; wherein rotation of the drum selectively rotates the operating cord around a portion of the drum; and the first plane is substantially perpendicular to the second plane; and the housing further includes a first set of catches extending downwardly into the receiving recess from an upper surface of the housing; and a second set of catches extending horizontally into the receiving cavity from a bottom surface of the housing; wherein the first set of catches interact with the first set of engagement members and the second set of catches interact with the second set of engagement members.

14. The covering of claim 13, wherein the drum further includes a wrapping surface extending downwardly from a bottom surface of the drum, and the operating cord wraps around the wrapping surface when the drum rotates in a first direction.

15. The covering of claim 13, wherein the first plane is substantially parallel to a length of extension of the rail.

16. A covering for an architectural opening comprising:

a headrail;

a shade material suspended from the headrail;

a rail operably connected to an edge of the shade material;

a control system operatively associated with the headrail, the control system including a plurality of flexible lift elements operably connected to and supporting the rail, the lift elements being manipulated by the control system to adjust the effective length of the lift elements whereby the spacing of the rail from the headrail can be adjusted; and a connector operably connected to the rail and adjustably connected to one of the lift elements, the connector including a housing selectively positionable and operably connected to the rail;

a rotatable drum rotatably seated within a portion of the housing; and a first catch system and a second catch system, wherein the two catch systems hold the drum in a position relative to the housing; wherein a position of the connector along a length of the connected lift element is variable and the spacial orientation and position of the rail is determined by location of the connector to the connected lift element; and the housing has a receiving recess to rotatably receive the drum, a cord recess in the housing, and a communicating passage between the receiving recess and the cord recess, wherein the one of the lift cords extends into the cord recess and through the passage into the receiving recess where the one of the lift cords can be selectively wrapped about a cylindrical body of the drum to vary the effective length of the one lift cord.

17. The covering of claim 16, wherein the rail is substantially hollow and the connector is positioned interiorly within the rail, and the housing further including a spout communicating with the second recess and the exterior of the rail through which the element can pass.

18. The covering of claim 17, wherein the receiving recess has a central axial axis parallel with the spout and being displaced laterally from the spout.

19. An anchor for selectively securing a lift cord for a covering for an architectural opening, comprising:

a housing configured to be operably connected to a rail operably connected to the covering, the housing including a receiving recess defined in a main body; and a drum rotatably received within the receiving recess and configured to be operably connected to the lift cord, the drum including a first set of engagement members extending in a first plane; and a second set of engagement members extending in a second plane; wherein rotation of the drum selectively rotates the lift cord around a portion of the drum;

the first plane is substantially perpendicular to the second plane; and the housing further includes a first set of catches extending downwardly into the receiving recess from an upper surface of the housing; and a second set of catches extending horizontally into the receiving cavity from a bottom surface of the housing; wherein the first set of catches interact with the first set of engagement members and the second set of catches interact with the second set of engagement members.

20. An anchor for selectively securing a lift cord for a covering for an architectural opening, comprising:

a housing configured to be operably connected to a rail operably connected to the covering, the housing including a receiving recess defined in a main body; and a drum rotatably received within the receiving recess and configured to be operably connected to the lift cord, the drum including a first set of engagement members extending from a first end of the drum in a first plane and engageable with the housing; and a second set of engagement members extending from a second end of the drum opposite the first end in a second plane and engageable with the housing; wherein rotation of the drum selectively rotates the lift cord around a portion of the drum;

the first plane is substantially perpendicular to the second plane;

the housing further includes a pair of ears operably connected to either side of the main body; and the housing further includes a pair of connection members that extend upwardly and outwardly from the main body and are connected to the pair of ears.

21. A covering for an architectural opening comprising:

a headrail;

a shade material suspended from the headrail;

a rail attached to an edge of the shade material;

a lift cord having an effective length extending between the headrail and the rail, wherein the effective length of the lift cord is adjustable to change the distance between the rail and the headrail;

a housing attached to the rail; and a drum seated within a portion of the housing and rotatable relative to the housing about a rotation axis, wherein the drum is operably attached to the lift cord such that rotation of the drum about the rotation axis wraps the lift cord about the drum or unwraps the lift cord from the drum to adjust the effective length of the lift cord; and the rotation axis is parallel to and spaced laterally from the effective length of the lift cord.

22. An anchor for selectively securing a lift cord for a covering for an architectural opening, comprising:

a housing configured to be operably connected to a rail operably connected to the covering, the housing including a receiving recess defined in a main body; and a drum rotatably received within the receiving recess and configured to be operably connected to the lift cord, the drum including a first set of engagement members extending in a first plane and configured to retain the drum in an angular position relative to the housing; and a second set of engagement members extending in a second plane and configured to further retain the drum in the angular position relative to the housing; wherein rotation of the drum selectively rotates the lift cord around a portion of the drum; and the first plane is substantially perpendicular to the second plane.

23. A covering for an architectural opening comprising:

a head rail;

a shade operably connected to the head rail;

a rail operably connected to the shade;

an operating element operably connected to the shade and configured to transition the shade between an extended position and a retracted position; and an anchor operably connected to the rail and the operating element, the anchor including a housing operably connected to the rail, the housing including a receiving recess defined in a main body; and a drum rotatably received within the receiving recess and operably connected to the operating element, the drum including a first set of engagement members extending in a first plane and configured to retain the drum in an angular position relative to the housing; and a second set of engagement members extending in a second plane and configured to further retain the drum in the angular position relative to the housing; wherein rotation of the drum selectively rotates the operating cord around a portion of the drum; and the first plane is substantially perpendicular to the second plane.

24. An anchor for selectively securing a lift cord for a covering for an architectural opening, comprising:

a housing configured to be operably connected to a rail operably connected to the covering, the housing including a receiving recess defined in a main body; and a drum rotatably received within the receiving recess and configured to be operably connected to the lift cord, the drum including a first set of engagement members extending in a first plane and engageable with the housing; and a second set of engagement members extending in a second plane and engageable with the housing; wherein rotation of the drum selectively rotates the lift cord around a portion of the drum;

the first plane is substantially perpendicular to the second plane; and the housing is a rigid material having sufficient resiliency to snap-fit into the rail, wherein the drum further includes a sidewall extending from a bottom surface, wherein the lift cord is configured to wrap around at least a portion of the sidewall and the first set of engagement members are defined on an upper edge of the sidewall.

25. An anchor for selectively securing a lift cord for a covering for an architectural opening, comprising:

a housing configured to be operably connected to a rail operably connected to the covering, the housing including a receiving recess defined in a main body; and a drum rotatably received within the receiving recess and configured to be operably connected to the lift cord, the drum including a first set of engagement members extending in a first plane and engageable with the housing; and a second set of engagement members extending in a second plane and engageable with the housing; wherein rotation of the drum selectively rotates the lift cord around a portion of the drum;

the first plane is substantially perpendicular to the second plane; and the housing is a rigid material having sufficient resiliency to snap-fit into the rail, wherein the housing further includes a first set of catches extending downwardly into the receiving recess from an upper surface of the housing and a second set of catches extending horizontally into the receiving cavity from a bottom surface of the housing, wherein the first set of catches interact with the first set of engagement members and the second set of catches interact with the second set of engagement members.

26. An anchor for selectively securing a lift cord for a covering for an architectural opening, comprising:

a housing configured to be operably connected to a rail operably connected to the covering, the housing including a receiving recess defined in a main body; and a drum rotatably received within the receiving recess and configured to be operably connected to the lift cord, the drum including a first set of engagement members extending in a first plane and engageable with the housing; and a second set of engagement members extending in a second plane and engageable with the housing; wherein rotation of the drum selectively rotates the lift cord around a portion of the drum;

the first plane is substantially perpendicular to the second plane; and the housing is a rigid material having sufficient resiliency to snap-fit into the rail, wherein the drum further defines a tool aperture configured to receive a tool for selectively rotating the drum within the receiving recess, wherein the housing further defines a hole in an upper surface, wherein the hole defined in the housing is substantially aligned with the tool aperture in the drum.

* * * * *